United States Patent [19]

Maddox

[11] 4,001,838

[45] Jan. 4, 1977

[54] METHODS AND APPARATUS FOR CLEANING PAPER IN A HIGH SPEED ELECTROSTATIC PRINTING APPARATUS

[75] Inventor: Ronnie Joseph Maddox, San Jose, Calif.

[73] Assignee: ElectroPrint, Inc., Cupertino, Calif.

[22] Filed: Apr. 1, 1974

[21] Appl. No.: 456,508

[52] U.S. Cl. ..... 346/153; 15/256.51; 118/73; 134/122 R

[51] Int. Cl.[2] ..... G03G 21/00

[58] Field of Search ..... 346/74 ES, 74 LB, 74 EB; 134/122 R, 130, 9, 15; 118/DIG. 23, 104, 73; 15/256.5, 256.51; 355/10, 15

[56] References Cited

UNITED STATES PATENTS

| | | | |
|---|---|---|---|
| 577,300 | 2/1897 | Harris | 317/2 A |
| 3,221,755 | 12/1965 | Wright | 134/122 |
| 3,301,156 | 1/1967 | Roeber | 118/DIG. 23 |
| 3,372,027 | 3/1968 | Gundlach | 118/DIG. 23 |
| 3,598,487 | 8/1971 | Mizuguchi | 355/15 |
| 3,620,800 | 11/1971 | Tamai | 355/15 |
| 3,807,853 | 4/1974 | Hudson | 355/15 |

*Primary Examiner*—Jay P. Lucas
*Attorney, Agent, or Firm*—Townsend and Townsend

[57] ABSTRACT

In an electrostatic high speed line printer, a pair of lightly wetted cylindrical rollers are sequentially arranged upstream of the print station to engage the paper surface to be printed. The roller surfaces are wetted with a very thin film of non-staining viscous film such as isopar, and driven at roughly the same speed as the paper causing the paper surface to be very slightly wetted, thereby tending to attract debris particles from the surface of the paper to the roller and also tending to cause other debris particles to be adhered to the paper surface at least until after they have passed through the print head. A dancer roller is positioned on the opposite side of the paper from the wet rollers, between the wetted rollers, to provide approximately 30° of wrap across each wetted roller. The foregoing is disclosed in combination with an electrostatic high speed line printer wherein an image (or data) modulated stream of air ions is attracted toward an electrode positioned behind and supporting the print receiving paper. The modulated ion stream passes through a fine mist or cloud of substantially uncharged ink particles which are charged in a pattern corresponding to the modulated pattern of the ion stream and attracted to the paper surface to cause printing in accordance with such patterns. Very high speed operation, up to and exceeding 10,000 lines of print per minute, are shown.

46 Claims, 2 Drawing Figures

METHODS AND APPARATUS FOR CLEANING PAPER IN A HIGH SPEED ELECTROSTATIC PRINTING APPARATUS

BACKGROUND OF THE INVENTION

The present invention relates to the art of cleaning sheet-like materials, and particularly fibrous materials, such as paper. More particularly, the present invention relates to a wet roller system for removing debris from paper in a high speed electrostatic printing device, such as a computer printer. A very thin film of viscous liquid is formed on two sequentially arranged rollers supporting the print receiving surface of the paper immediately prior to the print head, thereby removing debris from the paper just before the printing stage.

While the use of wetted objects are well-known for purposes of removing unwanted particles from surfaces, electrostatic printing, and particularly high speed electrostatic printing, has numerous special requirements that would normally dictate against the use of a wetted surface for removing or settling loose paper fibers or other debris on the paper immediately prior to printing. For example, the invention is designed specifically for use in a high speed computer printer utilizing liquid ink. Normally, if paper is wet when printed upon, the ink has a tendency to spread or feather upon contact with the paper resulting in an unacceptable low quality image. The present invention utilizes very thin liquid films to achieve substantial cleaning without appreciable deterioration of print quality.

Although paper dust, fibers and other debris on the surface of paper can lead to problems in any mechanical equipment handling or processing the paper, these problems are particularly acute in the case of electrostatic printers, and particularly in a high speed line printer designed to print-out computer data. In a high speed computer line printer constructed by the present assignee, a stream of air ions is modulated by passing the ions through small modulator apertures having an electrical field in them corresponding to data to be printed. The image modulated ion stream is attracted by an electrical field toward the print-out paper and passes through a mist of uncharged liquid ink droplets prior to striking the paper, whereupon the droplets become charged upon contact with the ions and are attracted toward the paper by the same field attracting the ions. The paper advances past the printing station at speeds up to and exceeding 10,000 lines of print per minute. Debris from the paper tends to clog the fine apertures of the ion modulating apparatus. Paper fibers that are deposited in the print area can also enter the ink cloud and act as collectors of the small ink droplets therein, eventually agglomerating sufficient ink to form an oversized droplet which could deposit on and objectionably mark the paper. The ink mist printing technique described above is disclosed in commonly assigned U.S. Pat. No. 3,779,166 of Pressman, et al., particularly at FIG. 8A thereof. The manner of forming an image modulated ion stream in a line printer is shown in commonly assigned U.S. Pat. No. 3,689,935 of Pressman, et al.

Several other techniques have been tried in an attempt to control paper particles and fibers in the subject computer printer. In one such technique, it was attempted to vacuum the paper before it entered the print receiving area; however, the vacuuming apparatus was bulky and noisy and, due to the small size of the debris particles, very high air flows were required in order to exert sufficient pressure on the particles to remove them from the paper. Additionally, it was discovered that if the paper surface is allowed to scrape against anything after leaving the vacuum area, additional particles and fibers are dislodged from the paper surface, thereby tending to defeat the vacuuming operation. Further, the vacuum tended to place an objectionably large degree of drag on the paper. While it is most desirable to place the cleaning station immediately prior to the printing station, this proved difficult or impossible to achieve with a vacuum cleaning technique because the vacuum air flows tended to distort the ink cloud at the printing station thereby disrupting printed image causing inferior quality printing.

Efforts to blow the dust particles from the paper with an air knife or the like were equally unsatisfactory inasmuch as this technique had essentially all the disadvantages of vacuuming, in addition to which it simply blew the particles into the atmosphere often to settle in some other undesirable location in the system.

Similarly, efforts to employ electrostatic cleaning techniques, such as by placing a positive charge on the paper and running it past a negative electrode prior to the printing stage, were equally unsatisfactory. Arcs were often produced by the presence of long fibers moving into the electrical field and these arcs tended to damage the thin corona wire. Further, difficulties were encountered in collecting the charged debris particles once they were removed from the paper.

Loose paper fibers and other debris from the paper surface has also been a problem in mechanical printers and other paper handling apparatus simply because the debris tends to clog any mechanism. Similar problems can exist in equipment for operating or handling any sheet-like material which is fibrous, or for any reason, which normally carries unwanted loose particulate matter on its surface.

Another problem encountered in electrostatic printing is that even though most loose particles are removed, dust or other small particles can be dislodged from the paper surface by an electrical field if the dust particles are themselves electrically charged.

SUMMARY OF THE INVENTION

The present invention provides for coating a roller with a very thin film of viscous liquid and causing the roller to engage the paper surface immediately prior to entering the printing area. Debris particles tend to be attracted from the paper to the wet roller. Additionally, those particles that remain on the paper are moistened and tend to adhere to the paper at least until after the paper passes through the critical print area where loose particles might be dislodged.

An object of the present invention is to remove debris from the print receiving medium in an electrostatic printing process prior to printing.

Another object of this invention is, in an electrostatic printing system, to coat a roller with a thin film of liquid and to pass the print receiving surface of paper or other print receiving material across the roller to remove dust and other particles from the paper immediately prior to printing.

A further object of the present invention is to use a plurality of wetted rollers in sequence to remove a very high percentage of debris from the surface of paper or other sheet material.

Still another object of the present invention is to select the most appropriate liquid materials for use in a wet roller debris removal apparatus for a high speed electrostatic print system.

A further object of the present invention is to utilize a multiple roller system for debris removal and, at the same time, to prevent the paper from rippling or flapping in the printing region at high speeds.

Another object of the present invention is to provide a debris removal system that minimizes drag on the paper or other sheet material being cleaned.

Other objects of the present invention include controlling loose or easily loosened debris on the surface of any sheet-like fibrous material, such as by removing it or causing it to adhere to the material, and, in some instances, by removing the electrical charge from the debris particles.

These and other objects of the present invention will become more apparent, and the manner in which they are achieved will be described, by reference to the drawing and the following description of a preferred embodiment.

While the benefits of the cleaning method and apparatus of the present invention are particularly noteworthy in the high speed electrostatic line printer described herein, the present invention is not necessarily limited to that specific environment, but, in its broadest application, can be embodied in any system where it is desired to remove unwanted loose or easily loosened particulate matter from the surface of any debris-carrying sheetlike material, such as fibrous materials. Other applications include, for example, paper sorters, cutters, stackers, and converting machines. The terms "electrostatic printer" or "electrostatic printing apparatus" as they appear herein are not limited to computer line printers, but include electrostatic print-out apparatus in electrostatic facsimile transmission systems, copier systems, plate making systems and other similar systems, where images, data, symbols, characters, or the like, are electrostatically printed on the surface of a receiving material in developed or undeveloped form. Likewise, the print receiving material may be a web of material as shown, or it may be a plurality of individual sheets, and it may be paper, film, polymeric sheet, or any other sheet-like print receiving material utilized in a printer.

BRIEF DESCRIPTION OF THE DRAWING

For affording a more complete understanding of the invention and fuller understanding of the above and other features, advantages, and objects thereof, the accompanying drawing depicts a preferred embodiment of the invention.

In the drawing.

DESCRIPTION OF THE PREFERRED EMBODIMENT

Figure 1:
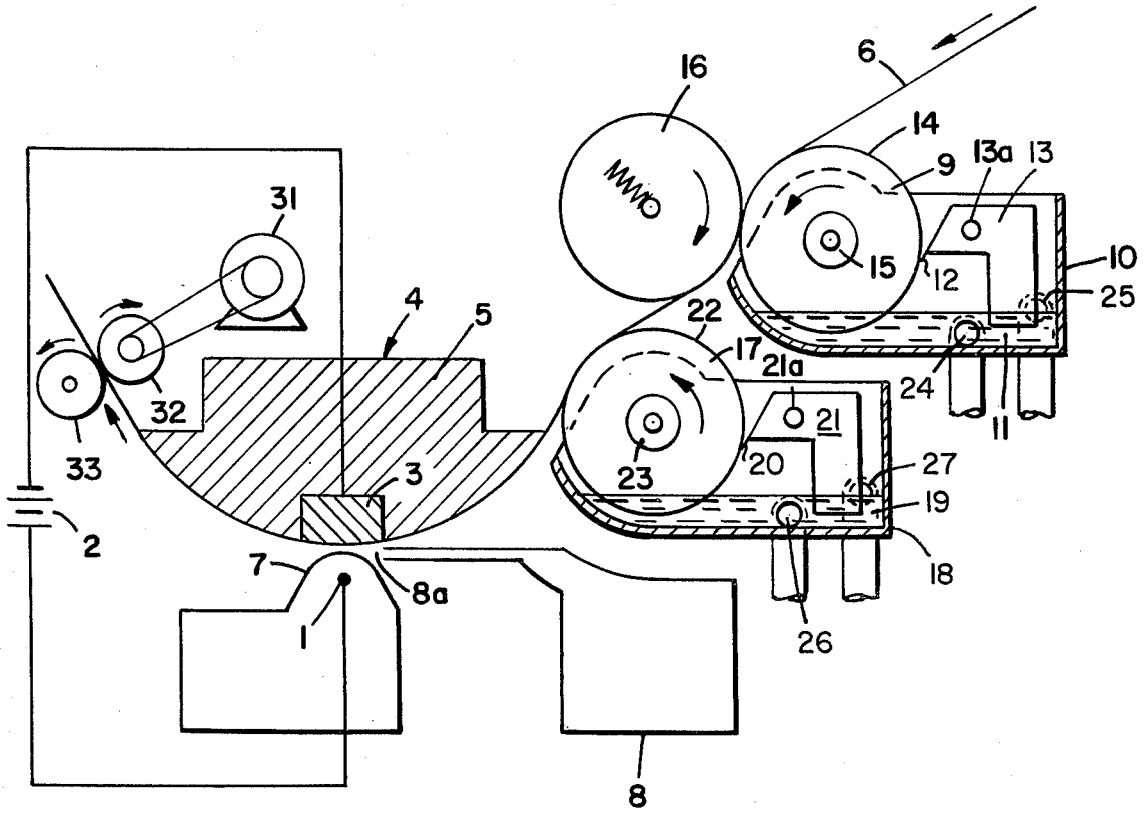
FIG. 1 is a schematic diagram of the printing region and associated debris removal system in a high speed electrostatic printer in accordance with the principles of the present invention.

Referring more particularly to the drawing, reference numeral 1 indicates a corona wire for producing air ions. This corona wire is a very small (for example, on the order of 0.001 to 0.003 inches in diameter) and is very susceptible to breaking when electrical arcs occur between the corona wire and other parts of the apparatus. A source of electrical potential 2 is connected between the corona wire 1 and an electrode 3, which is positioned opposite the corona wire 1 thereby establishing an electrical field between the corona wire 1 and the electrode 3. The electrode 3 is embedded in dielectric or semi-conductor material 5 to support the electrode 3, and also to support the paper 6 during passage between the corona wire 1 and electrode 3. The electrode 3 is embedded in dielectric or semi-conductor material 5 to support the electrode 3, and also to support the paper 6 during passage between the corona wire 1 and electrode 3. A more complete description of this portion of the printer appears in commonly assigned co-pending application of Thompson, filed 5/11/73, U.S. Ser. No. 359,287, entitled "Electrostatic Printer Support With Conrolled Electrostatic Surface Voltage" and in the two commonly assigned patents listed above. Air ions generated at the corona wire 1 are attracted toward the electrode 3 by the overall applied electrical force generated by the source 2. The ion stream passes through an apertured electrostatic modulator 7, preferably in the form of an aperture board of the type described in commonly assigned co-pending application of Klein filed 5/11/73 U.S. Ser. No. 359,288 now U.S. Pat. No. 3,863,261 entitled "Electrically Addressed Apertured Modulator for Electrostatic Printing". Electrical signals from a data source such as a computer (not shown) are transmitted to the aperture board to produce fields in the board apertures to modulate the ion stream in accordance with data emanating from the data source. The modulated ion stream impinges upon a mist of substantially uncharged ink droplets emanating from the mist generator 8. Those mist droplets which are struck by ions become electrically charged and are electrostatically attracted to the back electrode 3, causing them to impinge upon the paper 6. Suitable mist generating apparatus for use in the subject high speed printer is disclosed in a co-pending commonly assigned patent application of Klein et al., filed 5/11/73 U.S. Ser. No. 359,286 now U.S. Pat. No. 3,967,549 entitled "Electrostatic Printing System and Method Using Ions And A Mist Of Toner Particles Including Methods and Apparatus For Generating, Delivering, Recovering and Reprocessing The Toner Mist". The mist supplied to the print head by mist generator 8 should be highly uniform so that significant variations in ink density do not occur in the printing. Preferably, a lateral component of velocity is imparted to the mist as it leaves the generator so that it travels in a direction parallel to the paper. Mist movement in other directions should be minimized for optimum results.

Immediately prior to its entry into the printing zone, the paper 6 passes through a series of 3 rollers 9, 16, and 17. Rollers 9 and 17 are sequentially spaced along the paper path and engage the print receiving surface of the paper, i.e., the paper surface facing the corona wire 1. The rollers 9, 17 are each associated with containers 10, 18 holding a reservoir of liquid 11, 19. The rollers 9, 17 are positioned so that their axes of rotation extend in a direction parallel to the surfaces of the liquid 11, 19, and also to the surface of the paper 6. Additionally, the axes of rotation of the rollers 9, 17 extend in a direction perpendicular to the direction of paper travel. The lower surfaces of the rollers 9, 17 are immersed in and wetted by the liquid reservoirs 11, 19. The rollers 9, 17 are driven in rotation by motors 15,

23, to essentially provide a circumferential roller velocity matching the transport speed of the paper 6. This minimizes drag on the paper, and also mitigates against causing the paper to slide across the roller surfaces, which could result in undesirable friction-generated electrostatic charges being imparted to the paper immediately prior to printing. Liquid reservoirs 11 and 19 are maintained at constant predetermined levels and the liquid is circulated by means of a suitable pumping and drainage apparatus (not shown) associated with the inlets 24, 26 and drain outlets 25, 27. Doctor blades 12, 20 are mounted on mounting blocks 13, 21 attached to the walls of the containers 10, 18. The doctor blades are positioned to engage the cylindrical surfaces of the rollers 9, 17 in a tangential relationship thereto. Tension of the doctor blades 12, 20 against the surfaces of the rollers 9, 17 can be adjusted by suitable adjustment means (for example, by an adjustment pivoting the blades mounting blocks 13, 21 about mounting pivots 13*a*, 21*a*). Rollers 9, 17 will sometimes be referred to elsewhere herein as "wet rollers" or "wetted rollers" to distinguish them from other rollers in the system.

A resiliently mounted roller 16 is disposed against the back surface of the paper 6 (i.e., against the surface that is not intended to be printed) and will hereinafter sometimes be referred to as the "dancer roller". Dancer roller 16 engages the paper 6 as it passes between wet rollers 9 and 17 on the side of the paper 6 and opposite that engaged by the wet rollers 9 and 17. The dancer roller serves to impart a constant tension to the paper 6, and to hold it against the wet rollers 9, 17, and, also, to provide several degrees of wrap thereabout in order to lengthen the amount of time that the paper engages the wet roller paper surface. Paper is supplied to the wet rollers from a paper source (not shown) and, after passing through the printing zone, is carried off by pick-up rollers 32 and 33, driven by motor 31. Suitable paper feed and take-up mechanisms for use in the subject high speed electrostatic printer are disclosed in commonly assigned co-pending application of Ronald Albo filed 5/11/73, U.S. Ser. No. 359,285 entitled "Paper Feed System For High Speed Non-Impact Printing Apparatus" now abandoned.

In the operation of the present invention, the lead edge of the paper 6 coming from the paper source (not shown) is threaded across the upstream wet roller 9 beneath dancer roller 16, across downstream roller 17, between the back bar 4 and the aperture board 7, and then between take-up rollers 31, 32. When the paper drive and printing mechanisms are actuated, the wet rollers 9 and 17 are driven to provide circumferential velocity essentially matching the paper transport velocity.

Figure 2:
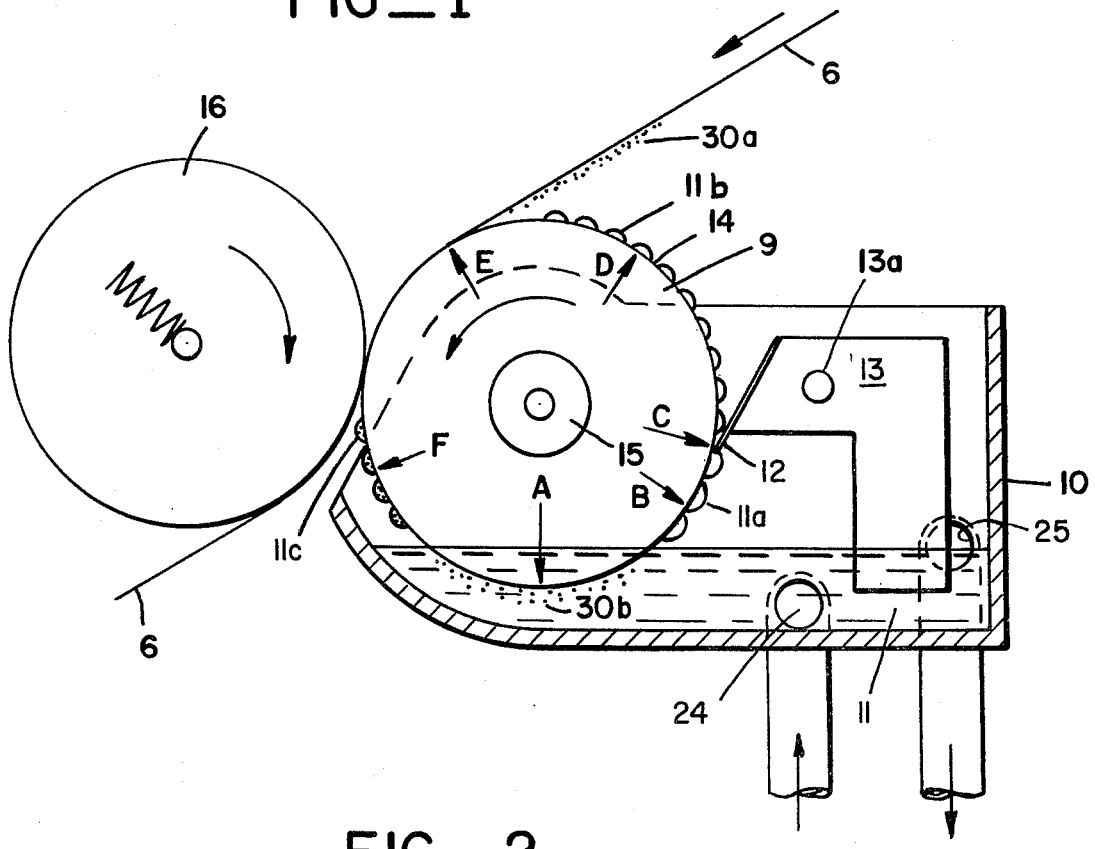
FIG. 2 is an enlarged detail drawing of the wet roller portion of FIG. 1.

FIG. 2 of the drawings illustrates the operation of the present invention with respect to one of the two wet rollers of the system (i.e., with respect to upstream roller 9). Debris on the to-be-printed surface of the paper 6, prior to its entry into the wet roller system, is indicated by numeral 30*a*. A thin film of liquid on the surface of the roller 9 is indicated by droplets bearing the numeral 11*b*. This thin film of liquid engages the debirs bearing surface of the paper 6 and causes the debris 30*a* to be attracted to and collected on the surface of the wet roller, as indicated by the debris laden film labeled 11*c*. Debris laden film 11*c* is carried by the surface of the wet roller 9 into the liquid reservoir 11, where the debris 30*b* is carried away. Liquid in the reservoir 11 is constantly circulated through the inlet 24 and the outlet 25, during which process particulate matter 30*b* may be strained out to prevent the liquid reservoir itself from becoming debris laden. When the surface 14 of the wet roller 9 emerges from the liquid reservoir 11, it carries relatively large amounts of liquid, represented by the large liquid droplets 11*a* of FIG. 2. These droplets are engaged by the doctor blade 12 prior to the point where surface 14 and wet roller 9 engages the paper 6. The doctor blade 12 serves to control the thickness of the liquid film on the wet roller 9 and also assists in removing debris from the roller not previously washed off in the reservoir. Thus, there are 6 separate stations or stages through which one wet roller passes in the course of a single cycle of wet roller operation. These are indicated by the letters A through F in FIG. 2. The wash/wet station A is where the roller is washed free of debris and picks up clean liquid for subsequent wet cleaning operation. In zone B, liquid droplets 11*a* are transported from the reservoir 11 to the doctor blade 12. At the doctor blade station C, the droplets 11*a* are scraped from the surface 14 of the cylinder 9 leaving a thin film of liquid. In zone D, the thin film of liquid (designated by the small droplets 11*b*) is transported from the doctor blade station C to the paper engaging zone E where it attracts particles 30*a* from the surface of the paper 6. Finally, in zone F, the wet film (designated by numeral 11*c*) carries debris away from the paper surface. Upon re-entering zone A, the debris 30*b* from wet film 11*c* is washed free of the wet roller surface 14. Operation of the downstream wet roller 17 is substantially the same, although paper reaching the downstream roller 17 has already been at least partially cleaned.

The surfaces 14, 22 of the wet rollers 9, 17 are preferably electroless nickel plated over steel, coated to approximately one mil. thickness and highly polished. The doctor blade is preferably on the order of 0.002 inches thick stainless steel. The tension of the doctor blade against the wet roller surface, and the texture of the wet roller surface, combine to determine the thickness of the thin film carried by the wet roller in zone D. The film thickness is most conveniently measured in relation to the consumption of reservoir liquid 11 over a certain area of paper 6. For computer print-out utilizing conventional fan-fold paper, the area of paper is most conveniently expressed by reference to the number of fan-fold sheets passing a given point in the system. Where each fan-fold sheet is approximately 11 inches by 14 ⅞ inches, the preferred film thickness consumes fluid from the reservoir at the rate of approximately 5 grams of fluid per 1,000 sheets (5 gm/000 sheets). When an insufficient quantity of liquid is employed, the roller does not pick up adequate amounts of debris. On the other hand, if too much liquid is employed, the paper tends to stain and the ink tends to spread or feather causing objectionably fuzzy print. The preferred wetting liquid is transparent, non-staining, and viscous (e.g., in the range of 1–200 cp. at 20° C or higher). While it may be electrically insulative, improved cleaning can result from the use of an electrically conducting or semiconductive fluid since this tends to dispel electrical charge on the paper. Small charged particles which remain on the paper after cleaning can be undesirably dislodged by electrical fields in the print head. This problem tends to be overcome when conductive or semi-conductive wetting liquids are employed. The preferred wetting liquid is an isopar sold under the trademark "ISOPAR-M" which is a highly refined, viscous product sold by the Humble Oil Co. Isopar-M has the advantges of being readily available, having a high flash point, high viscosity, and being relatively inexpensive. Additionally, Isopar-M leaves little or no residue upon vaporization, is non-toxic, and its odor is non-offensive. Isopar-M is an electrical insulator. Other suitable wetting agents include other isopars, silicone oils, polymers dissolved in trichloroethane, and other viscous non-corrosive transparent liquids including mineral oils. While film thickness of 5 gm/000 sheets (equivalent to about 5 micrograms/sq. cm) is preferred, the acceptable range of film thickness extends from as little as 2.5 gm/000 sheets (2.5 micrograms/sq. cm) up to about 20 gm/000 sheets (20 micrograms/sq. cm).

The diameter of each wet roller 9, 17 should be selected so that the roller is small enough to fit into the printing region, but not so small that its rotation generates centrifugal forces to cause the liquid to be flung from the roller surface. Wet roller diameters on the order of 1 inch are preferred for paper transport velocity on the order of 20 inches per second, which is well within the operating range of the machine. At a paper speed of 22 inches per second, the machine prints approximately 8000 lines per minute. At these speeds, the wet roller diameter should not be substantially less than about 1 inch.

It is preferred to use two sequenced wet rollers, as shown in FIG. 1 of the drawings. While a single wet roller provides substantial cleaning, a second roller provides improved cleaning. Still, three or more sequenced wet rollers could be employed for further improved debris removal, but two rollers have been found sufficient for the high speed computer printer.

The dancer roller is preferably positioned to provide about 30° of paper wrap per roller. This degree of wrap causes the paper to be engaged with the wet roller for a sufficient amount of time to provide a satisfactory degree of wetting to trap the debris on the wet roller surface 14 or to cause it to adhere to the paper 6 during the time that it passes through the printer.

The wet rollers are positioned immediately adjacent the print head (i.e., the region occupied by the corona wire 1, back electrode 3 and outlet **8*a* of the mist generator 8). Nothing engages the print receiving surface of the paper between the time it leaves the downstream wet roller 17 and the time that it enters the print head. Further, the downstream wet roller 17 is positioned as close as possible to the print head so that the distance that the paper must travel between the time it leaves the wet roller 17 and enters the print head is small, thereby minimizing opportunity for debris carried by the ambient atmosphere to deposit on the print receiving surface of the paper 6.**

The downstream wet roller 17 is also positioned so that it holds the paper against the back bar 4. Prior to the present invention, such as where vacuum or air knife devices were employed to remove debris from the paper, it was necessary to provide a mechanical bar or other urging mechanism to tension the paper against the back bar 4 and also prevent it from flapping or fluttering in the print head, which caused disruptive turbulenece. The use of this so-called "anti-flap" bar was undesirable since not only was it an additional part, but it was also a source of disturbance to the paper necessarily interposed between the paper cleaner and the print head. Additinally, it was a potential source of friction tending to undesirably charge the surface of the paper as it entered the print head, thereby disrupting printing and increasing debris deposited. The present invention has thus provided a mechanism capable of performing two functions that were previously required to be carried out by two separate mechanisms, while overcoming the disadvantages of both of those mechanisms.

The liquid reservoirs 11 and 19 are continually agitated by pumping liquid in and out of the inlets 24, 26 and outlets 25, 27. Circulation of the liquid prevents the debris from forming a film at the top of the liquid tending to collect on the roller surface as it emerges from the reservoir.

The drawings herein have not necessarily been drawn to scale. For example, the liquid droplets **11*b* in the wet film transport zone D are oversized for purposes of illustration. In practice, the film is so thin that it can scarcely be seen or felt. Another example is that the respective proportions of the bar 4 and aperture board 7 are not drawn to scale with respect to one another or with respect to the wet roller system. Also, the docotr blades 12, 20 are tensioned against the roller surface 14 instead of being slightly spaced therefrom as shown in FIG. 2** for purposes of illustration.

Although one embodiment of the invention has been shown and described, it will be obvious that other adaptations and modifications can be made without departing from the true spirit and scope of the inventon.

I claim:

1. Apparatus for controlling unwanted loose or easily lossened particulate matter on paper comprising:

means for edgewise transporting the paper along a path;

roller means positioned to engage one surface of the paper during transport along the path, said roller mounted for rotation such that its surface velocity substantially matches that of the paper at their respective points of engagment; and means for wetting the paper-engaging surface of said roller means with a thin film of liquid to wet the paper tending to cause a portion of the particulate matter to be held on the paper surface and to cause another portion of the particulate matter to be removed from the paper surface by adhering to said roller means.

2. Apparatus as recited in claim 2, wherein said roller means comprises at least two rollers positioned sequentially in the paper path, so that one of said rollers removes a portion of the unwanted particulate matter and the other of said rollers removes a further portion thereof.

3. Apparatus as recited in claim 1 further comprising means for driving said roller means at said substantially matching surface velocity.

4. Apparatus as recited in claim 1, wherein said wetting means applies the liquid to said roller means in quantities such that the liquid is deposited on the paper at the rate of about 5 micrograms/sq. cm.

5. Apparatus as recited in claim 1, wherein said wetting means applies the liquid to said roller means in quantities such that the liquid is deposited on the paper at the rate of between about 2.5 micrograms/sq. cm. and 20 micrograms/sq. cm.

6. Apparatus as recited in claim 5 further comprising means for driving said roller means at said substantially matching surface velocity.

7. Apparatus as recited in claim 6, wherein said roller means comprises at least two rollers positioned sequentially in the paper path.

8. Apparatus as recited in claim 7, wherein said liquid has a viscosity of about 1–200 cp. at 20° C.

9. Apparatus as recited in claim 8, wherein said wetting means comprises a liquid bath wetting the lower portion of said roller means, and further comprises a blade engaging said roller means to scrape the wetting surface of said roller means before it reaches the paper engaging position.

10. Apparatus as recited in claim 5, wherein said liquid has a viscosity of about 1 to 200 cp. at 20° C.

11. Apparatus as recited in claim 1, wherein said wetting means comprises a liquid bath wetting the lower portion of said roller means and further comprises a blade engaging said roller means to scrape the wetted surface of said roller means before it reaches the paper engaging position.

12. Apparatus as recited in claim 1, wherein said liquid has a viscosity of about 1 to 200 cp. at 20° C.

13. Apparatus as recited in claim 1, wherein said liquid has a viscosity of about 1 to 200 cp. at 20° C.

14. Apparatus as recited in claim 1 wherein said roller means has a cylindrical surface for engagement with the paper, said cylindrical surface being of a hard, smooth material.

15. Apparatus as recited in claim 14 wherein said hard smooth material is polished metal.

16. Apparatus as recited in claim 15 wherein said polished metal is electroless nickel.

17. Apparatus as recited in claim 14 wherein said means for wetting said roller means with a thin film of liquid includes means for applying liquid to said cylindrical surface of said roller means, and means for removing a portion of the applied liquid from said cylindrical surface to leave a controllably thin film of liquid on said cylindrical surface.

18. Apparatus as recited in claim 17 wherein said means for removing consists of a blade engaging said cylindrical surface to scrape said surface after liquid is applied but before it engages the paper.

19. Apparatus as recited in claim 18 wherein said blade is controllably tensioned against said cylindrical surface to control the thinness of liquid film left thereon.

20. Apparatus for controlling loose or easily loosened matter on sheet-like material comprising:

means for edgewise transporting the material along a path;

roller means having a hard, smooth cylindrical surface positioned to engage one surfce of the material, said roller mounted for rotation such that its surface velocity substantially matches that of the paper at their respective points of engagement; and means for wetting said cylindrical surface of said roller means with a thin film of liquid to wet the material tending to cause a portion of the particulate matter to be held on the paper surface and to cause another portion of the particulate matter to be removed from the paper surface by adhering to said roller means.

21. Apparatus as recited in claim 20, wherein said roller means comprises at least two rollers positioned sequentially in the paper path so that one of said rollers removes a portion of the unwanted particulate matter and the other of said rollers removes a further portion thereof.

22. Apparatus as recited in claim 20, wherein said liquid has a viscosity of about 1 to 200 cp. at 20° C.

23. Apparatus as recited in claim 20, wherein said roller means comprises at least one roller, said roller having a diameter of at least about 1 inch.

24. Apparatus as recited in claim 20, wherein said wetting means comprises a liquid bath wetting only the lower portion of said roller means, and further comprises a blade engaging said roller means to scrape the wetted surface of said roller means before it reaches the paper engaging position.

25. In apparatus for controlling unwanted particulate matter on print receiving material in an electrostatic printer having an electrostatic print head, including a source of air ions, an apertured ion stream modulator and means for generating an ink mist in the path of the modulated ion stream, a back electrode, and means for edgewise transporting the material along a path passing the print head for depositing print on the material, the improvement comprising:

roller means positioned to engage one surface of the material during transport along the path, said roller mounted for rotation such that its surface velocity substantially matches that of the paper at their respective points of engagement; and means for wetting the material-engaging surface of said roller means with a thin film of liquid to wet the material tending to cause a portion of the particulate matter to be held on the paper surface and to cause another portion of the particulate matter to be removed from the paper surface by adhering to said roller means.

26. Apparatus as recited in claim 25, wherein said liquid is semi-conductive or conductive so that electrostatic charges on the material tend to be dispelled upon deposit of the thin liquid film thereupon.

27. Apparatus as recited in claim 25, wherein said liquid is isopar.

28. Apparatus as recited in claim 25, wherein said roller means is positioned to hold said material against the back electrode in the print head so that the tendency of the material to flap in the print head is thereby reduced.

29. Apparatus as recited in claim 25 further comprising a resiliently mounted roller positioned to engage the surface of the material on the opposite side of the material from said roller means between said roller means during transport of the material along the path, to tension the material and urge it against said roller means, and also to cause the material to undergo at least several degrees of wrap about said roler means.

30. Apparatus s recited in claim 25, wherein said roller means is positioned immediately adjacent said print head.

31. Apparatus as recited in claim 25, wherein said roller means comprises at least two rollers positioned sequentially in the material path so that one of said rollers removes a portion of the unwanted particulate matter and the other of said rollers removes further portions thereof.

32. Apparatus as recited in claim 25 further comprising means for driving said roller means at a surface velocity substantially matching the velocity of the material at their respective points of engagement.

33. Apparatus as recited in claim 25, wherein said wetting means applies the liquid to said roller means in quantities such that the liquid is deposited on the material at the rate of about 5 micrograms/sq. cm.

34. Apparatus as recited in claim 25, wherein said wetting means applies the liquid to said roler means in quantities such that the liquid is deposited on the material at the rate of between about 2.5 micrograms/sq. cm. and 20 micrograms/sq. cm.

35. Apparatus as recited in claim 25, further comprising means for driving said roller means at a circumferential velocity substantially the same as the velocity at which the material is transported by the transporting means.

36. Apparatus as recited in claim 25, wherein said wetting means comprises a liquid bath wetting the lower portion of said roller means, and further comprising a blade engaging said roller means to scrape the wetting surface of said roller means before it reaches the material engaging position.

37. A method of controlling unwanted particulate matter on paper comprising:

applying liquid to the surface of a roller; removing a portion of the applied liquid from the roller surface leaving a controllable amount of the applied liquid on the roller surface as a liquid film;

rolling the film wetted surface of the roller along the paper to wet the paper and cause at least some of the particulate matter to adhere to the roller; and washing adhered particulate matter from the roller after engagement with the paper, wherein the washing and wetting steps are carried out with a single liquid bath.

38. A method of preparing sheetlike material for subsequent treatment comprising:

wetting a roller with a controllably thin film of semi-conductive or conductive liquid; and rolling the wetted surface of the roller across the material at a surface velocity approximating the velocity of the material at their respective points of engagement to wet the material thereby removing electrostatic charge from the sheet-like material, and causing the loose or easily loosened particulate matter on the sheet-like material to cling to the roller and/or sheet-like material.

39. A method of controlling loose or easily loosened particulate matter on the print receiving surface of a print receiving material in an electrostatic printer having a print head including a corona ion source, back electrode, appertured modulator, and ink mist generator, and further having means for transporting the print receiving material past the print head for receiving print thereon, such method comprising:

forming a controllably thin film of viscous liquid on the surface of at least one roller;

engaging the film-wet portion of the roller against the print receiving surface of the print receiving material adjacent and prior to the print head to wet the print receiving material and to adhere particulate matter to the roller; and causing the roller to rotate at a surface velocity approximating the transport velocity of the print receiving material at their respective points of engagement.

40. A method of controlling unwanted particulate matter on paper comprising:

applying liquid to the surface of a roller;

removing a portion of the applied liquid from the roller surface, leaving a controllable amount of the applied liquid on the roller surface as a liquid film; and rolling the film wetted surface of the roller along the paper at a surface velocity substantially matching the velocity of the paper at their respective points of engagement to wet the paper and cause at least some of said particulate matter to adhere to the roller.

41. The method of claim 40, wherein the liquid has a viscosity of about 1 to 200 cp. at 20° C.

42. The method of claim 41, wherein the liquid is electrically conductive or semi-conductive.

43. The method of claim 40, wherein the roller deposits liquid on the paper at a rate of between about 2.5 micrograms/sq. cm. and 20 micrograms/sq. cm.

44. The method of claim 40, wherein the liquid is electrically conductive or semi-conductive.

45. The method of claim 40, wherein the step of wetting the roller with a thin film of liquid includes the steps of wetting a portion of the roller with a liquid bath and then scraping that portion of the roller with a blade to remove unwanted amounts of liquid and form the thin film before that portion of the roller engages the paper.

46. The method of claim 40, including the further step of washing adhered particulate matter from the roller after engagement with the paper, wherein the washing and wetting steps are carried out with a single liquid bath.

* * * * *